United States Patent [19]

Kuzarov

[11] 4,004,780

[45] Jan. 25, 1977

[54] WINCH

[75] Inventor: Encho Janaki Kuzarov, Milwaukie, Oreg.

[73] Assignee: Warn Industries, Inc., Kent, Wash.

[22] Filed: Sept. 23, 1975

[21] Appl. No.: 615,848

[52] U.S. Cl. ..... 254/187.4

[51] Int. Cl.[2] ..... B66D 1/00

[58] Field of Search ..... 254/187 R, 187 A–187 H

[56] References Cited

UNITED STATES PATENTS

| | | | |
|---|---|---|---|
| 2,552,928 | 5/1951 | Benson | 254/187 A |
| 3,618,898 | 11/1971 | Notestine | 254/187 R |

*Primary Examiner*—Robert J. Spar
*Assistant Examiner*—Robert C. Watson
*Attorney, Agent, or Firm*—Graybeal, Barnard & Uhlir

[57] ABSTRACT

A winch having a clutch-brake assembly comprising a ratchet plate with a constantly engaged pawl, and two clutch shoes. With a tension load on the cable of the drum, two rotatably mounted cam members engage each other to move the clutch shoes into engagement with the ratchet plate to cause power to be transmitted to the drum of the winch. Under minimal or no external load, after the power source has been operated shortly in reverse, a spring maintains the clutch shoes out of engagement to permit the cable on the drum to be reeled out freely at a moderate rate of acceleration.

7 Claims, 13 Drawing Figures

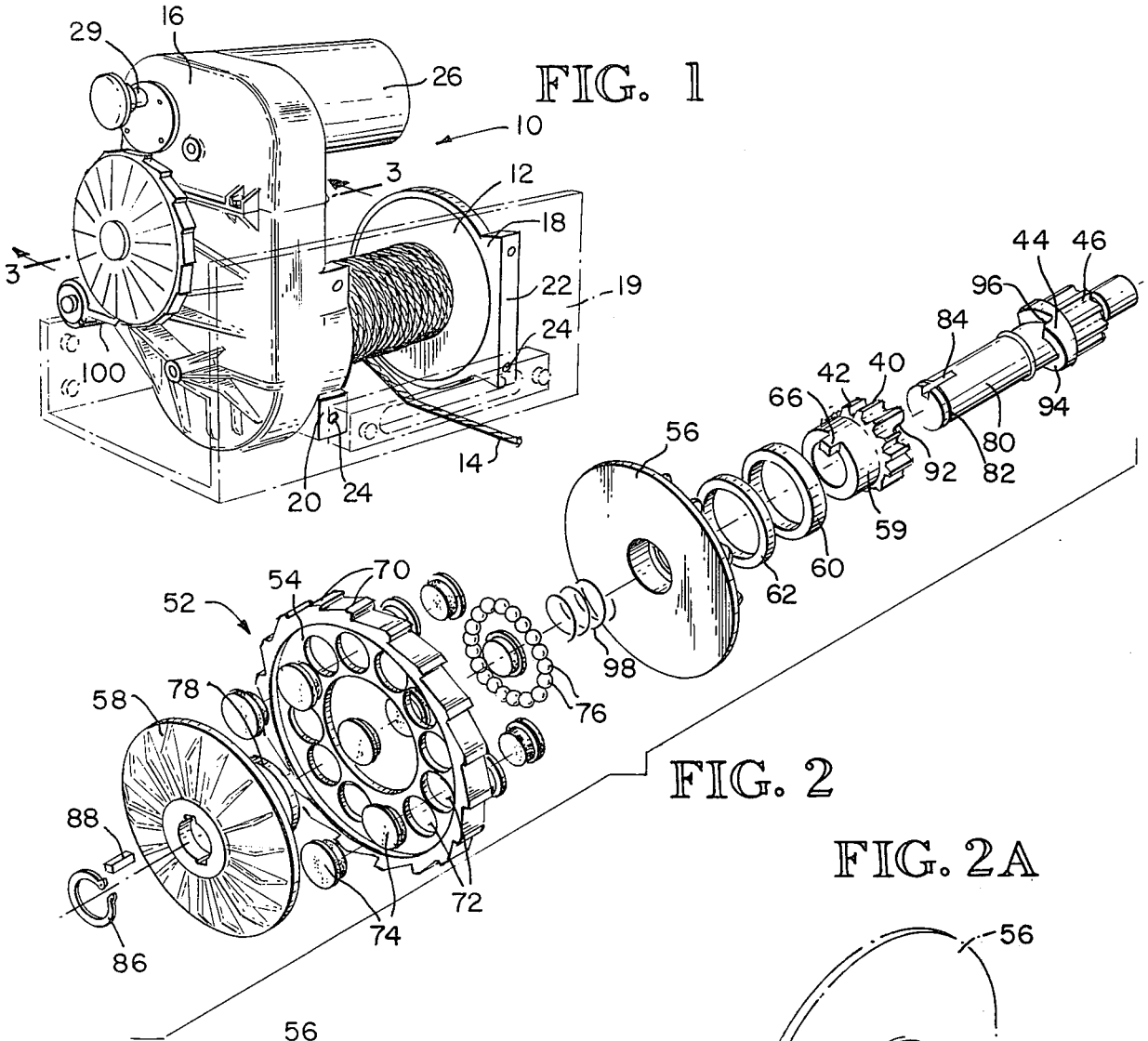
FIG. 1
FIG. 2
FIG. 2A
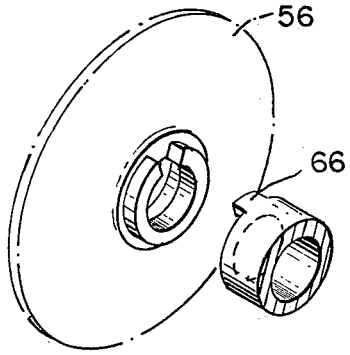
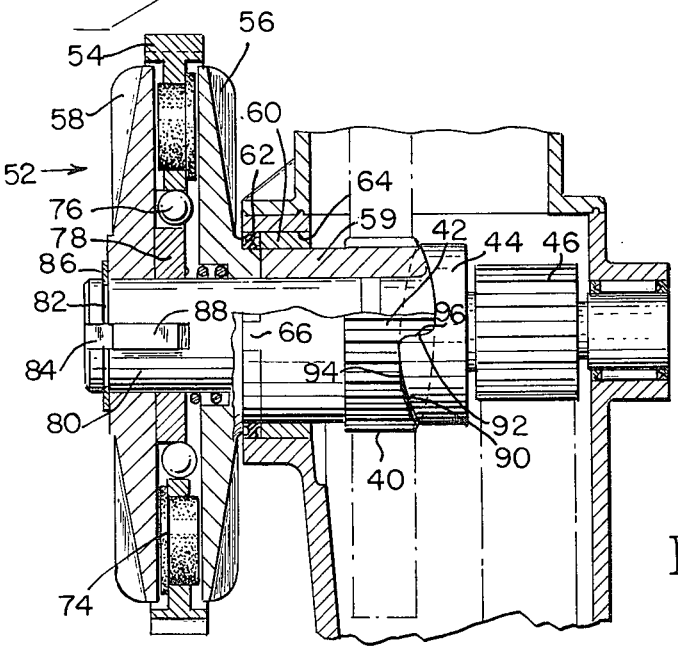
FIG. 3

FIG. 9
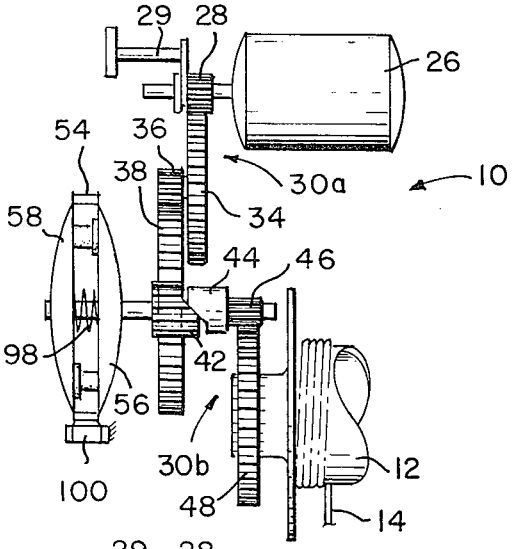
FIG. 10
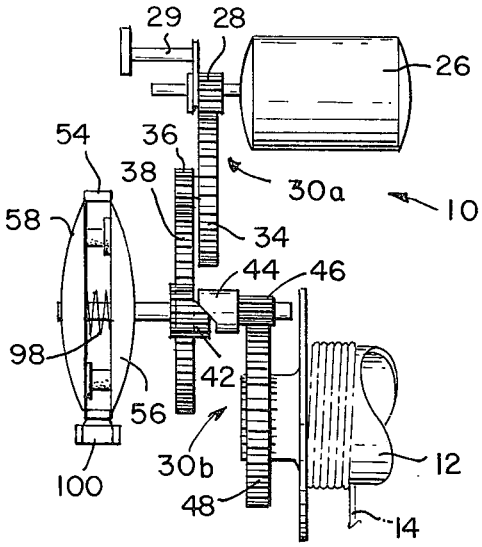
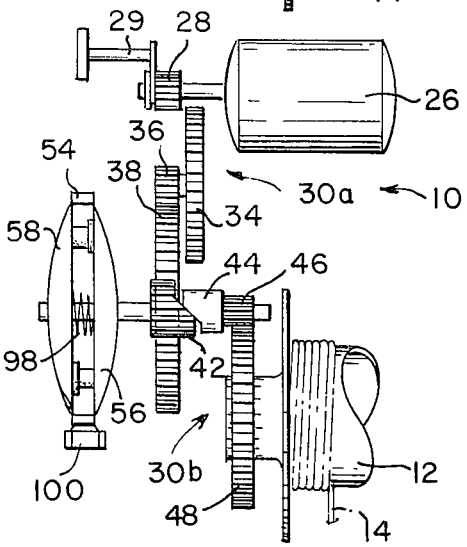
FIG. 12
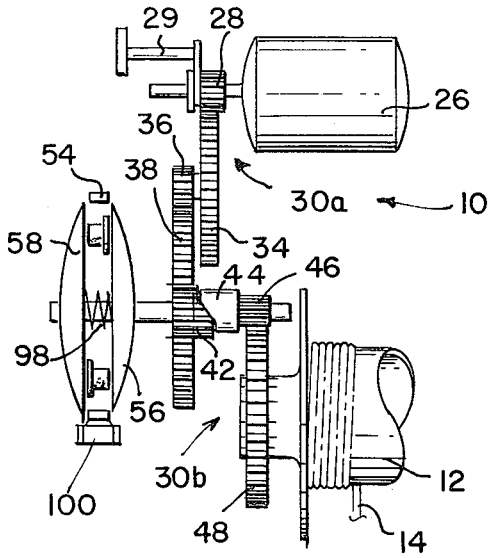
FIG. 11

WINCH

BACKGROUND OF THE INVENTION

1. Field of the Invention

This invention relates to a winch and more particularly to an improvement in the operating components of an existing prior art winch.

2. Description of the Prior Art

The most relevant prior art known to the applicant herein is a winch manufactured by Warn Industries, Inc. of Kent, Wash., the assignee of the present invention. That winch comprises a motor which transmits power through a speed reducing gear transmission to a first drive cam having an axially facing cam surface which engages an axially facing cam face of a second driven cam which through a further speed reducing transmission drives the cable winding drum of the winch. A clutch-brake assembly is operatively connected between the two cams, this assembly comprising a first shoe connected to the first cam to rotate therewith, a second shoe connected to the second cam to rotate therewith, and a ratchet plate positioned between the two shoes. There is a pawl which can be moved by an operating lever into and out of engagement with the ratchet plate. When the pawl is disengaged, the ratchet plate can move freely in either direction, and when the pawl is engaged, the ratchet plate can move only in the direction which the brake-clutch assembly rotates in reel in cable.

When the winch is operating under power in either direction, e.g. in raising or lowering a load, the pawl is positioned to be in engagement with the ratchet plate. When the winch is operated in a first direction to reel cable in, the drive cam engages the driven cam in wedging engagement to tend to move the two cams axially away from each other and to push the two shoes into engagement with the ratchet plate. This effectively locks up the two cams and the clutch assembly in a single rotating unit through which power is transmitted to the drum.

When the winch is operated in the opposite direction, e.g. in lowering a load, the drive cam moves in a direction out of wedging engagement with the second cam, so that it does not push the shoes of the brake-clutch assembly into engagement with the ratchet plate. However, a circumferentially facing shoulder of the drive cam engages a matching shoulder of the driven cam so that the driven cam is positively engaged to be moved in a direction to unwind cable. If the cable is under tension loading as in the instance of lowering a suspended mass, the tension load on the cable tends to cause the second driven cam to overrun the first drive cam to push the drive cam back into wedging engagement. Since the pawl in its engaged position does not permit rotation of the ratchet plate in a direction to unwind cable, as the two shoes come into frictional engagement with the ratchet plate, the ratchet plate acts as a governor to limit the rotational speed of the components to that which the motor imparts to them. When the winch motor is stopped, any tension loading on the cable moves the clutch-brake assembly into engagement to prevent the cable from unreeling. In this instance the clutch-brake assembly functions as a brake on the drum.

In the event that it is desired to unwind the winch cable at a relatively fast rate, the operating lever of the pawl is manipulated to move the pawl to its disengaged position, so that the ratchet plate is free to move in either direction. In this situation, the cable can be pulled out relatively easily, with the only restraining force being the internal drag of the operating components of the winch. However, after the cable is pulled out, the pawl must be moved back to its engaged position so that the clutch-brake assembly can perform its intended functions as indicated above.

While the above-described winch operates satisfactorily, it is possible for the careless operator to disregard the usual safety precautions in the improper operation of the winch. For example, with the winch mounted to the front bumper of a vehicle, the vehicle operator sometimes uses the winch as an auxiliary power source to travel very rugged terrain. To travel up a very steep hill, the operator sometimes takes the end of the cable and climbs up the hillside to attach the free end of the cable to a tree or other stationary object, with the brake pawl being disengaged so that the cable pays out more quickly as the operator moves away from the vehicle. The operator then returns to his vehicle and should engage the pawl, after which he turns on the winch motor to reel in cable so that the vehicle with the winch pulls itself up the incline, with or without assistance from the drive wheels of the vehicle. After reaching the desired level up the incline, the operator stops the winch motor, and with the brake pawl engaged the winch will hold the cable drum at its present position. If desired, the motor can be placed in reverse at a later time and the vehicle descends the hill at a controlled rate. However, if the operator neglects to engage the pawl, when the winch motor is stopped, only the internal drag of the operating components of the winch prevents the free paying out of cable. The rather substantial weight of the vehicle overcomes this relatively small retarding force, and the vehicle unfortunately descends the hill at a rate faster than that desired by the operator, even with the operator applying the wheel brakes of the vehicle in those instances where the incline is quite steep.

Another situation is that where an operator of a vehicle having a winch thereon wishes to lower himself into a ravine with the assistance of the winch. The operator parks the car near the edge of the ravine, secures himself to the end of the cable, starts the winch motor in a direction to pay out cable, and then steps over the edge of the ravine with the expectation that the controlled rate of paying out cable by the winch will provide a comfortably slow descent. However, unless the operator has taken the usual care to be sure the pawl is engaged, the drum is able to overrun the motor with the operator making the descent down the ravine at a rate somewhat faster than the operator had initially planned.

A possible solution to this problem is to modify the brake-clutch assembly so that it cannot freely rotate in a direction to pay out cable. However, this limits the rate at which cable can be payed out to the speed at which the winch can operate. Since the winch is usually geared for a high torque-low speed setting, this has the disadvantage of imposing an undesired limitation on the speed with which the cable can be unreeled from the drum. Consequently it sometimes leads to the operator tampering with the brake-clutch assembly to disengage it and permit the cable to pay out freely, which impairs the safe operation of the winch.

Another possible solution is to provide some sort of interlock between the motor and the pawl, so that the winch cannot operate under power unless the pawl is engaged. While this proposed solution does have merit, it leads to a more complex apparatus, and the addition of such complexities inherently produces further problems of reliability, as well as added expense, maintenance, etc.

Thus, it is an object of the present invention to provide an improvement to a winch such as that described above, to improve the operating characteristics of the winch with regard to the considerations discussed above.

SUMMARY OF THE INVENTION

The basis of the present invention lies in the recognition that when the two cams of the winch described above are in wedging engagement, there are certain significant relationships in the several force components which are directed parallel to the axis of rotation of the two cams in different operating modes of the winch. The several force components which are of significance are as follows:

a. When the winch drum rotated by an external force to pay out cable (as when a person pulls the cable out) at a constant speed, and with the clutch-brake shoes not engaging the ratchet plate, the internal drag forces that act on the first cam (i.e. the driving cam) result in a force component tending to move the two cams apart and in turn cause the clutch-brake assembly to become engaged. This force component is designated "Force A."

b. The winch has a practical minimum and maximum operating range with regard to the magnitude of the torque loads against which the drum acts. With the winch reeling in or paying out cable at the practical minimum operating limit, the torque load on the drum, acting back through the driven cam, produces a force component tending to move the two cams away from each other to cause the clutch-brake assembly to be engaged. This force component is designated "Force B."

c. With the clutch-brake assembly disengaged, and with a tension load being applied to the cable so that cable is paying out at an accelerating rate of speed, there is a practical upper limit to the level of acceleration of rotational speed of the winch drum. At such level of acceleration, the frictional drag forces that act on the first drive cam and the inertial forces of those components which act on the first drive cam are additive, and these result in a force component tending to move the two cams away from each other and cause the clutch-brake assembly to become engaged. This force component is designated "Force C."

With regard to these three force components, in the prior art winch described above, Force A is less than Force B or Force C. Force B may or may not be greater than Force C.

With this recognition of the above force relationships, the present invention resides in modifying the prior art winch described above by (a) providing a biasing means to provide a force component, designated "Force D," to act against the force components that tend to move the two cams away from each other so as to move the clutch-brake assembly to its disengaged position, with the biasing means being such that the value of Force D is greater than Force A, but less than either Force B or Force C, and is desirably of a value near to Force B or Force C, and (b) providing pawl means in constant engagement to restrain at all times rotation of the ratchet plate of the clutch-brake means in a direction to pay out cable.

In the preferred embodiment of the present invention, the biasing means is in the form of a compression spring positioned between the two clutch-brake shoes, tending to push the shoes out of engagement with the ratchet plate. The constantly engaged pawl means to restrain rotation of the ratchet plate of the clutch-brake means is, in this preferred embodiment, a constantly engaged pawl for the ratchet plate. These two elements, in combination with the other main operating components of a winch, such as that described above in the discussion of the prior art, provide significantly improved operating characteristics.

With regard to such operating characteristics, let us consider four operating situations.

a. With the winch operating under power to reel in cable, as in lifting a load, the tension on the cable is such that Force B is greater than Force D, so that the clutch-brake assembly is engaged. In effect the winch operates with the same effectiveness as the prior art winch in lifting the load.

b. With the winch operating under power to pay out cable, as in lowering the load, the same situation exists as in paragraph (a) immediately above. Force B is greater than Force D, and the clutch-brake assembly is in sliding engagement to act as a speed governor to prevent the drum from overrunning the motor. In effect, the winch again operates with the same effectiveness as in the prior art winch in lowering the load.

c. In a third situation, let it be assumed that the operator wishes to manually pay out cable from the drum to attach the free end of the cable to a distant object. The operator begins pulling the cable off the drum at a moderate rate of acceleration. The level of Force C is not reached, and Force D is adequate to keep the clutch-brake shoes out of engagement with the ratchet plate. Thus, while the pawl remains engaged with the ratchet plate, the drum rotates freely to pay out cable. This operating feature does not exist in the prior art winch.

d. To examine a fourth situation, let it be assumed that the operator is pulling out cable as indicated in paragraph (c) immediately above, and that the operator is walking in very rough terrain and accidentally steps over the edge of a steep incline while still holding the cable. This results in an abrupt acceleration of rate of rotation of the drum so that the level of Force C is reached to cause the clutch-brake assembly to engage and act as a brake to stop further rotation of the drum. Thus, the operator, if still holding the cable, is able to stop his descent and pull himself back up over the edge of the incline with the aid of the cable.

Other features of the present invention will become apparent from the following detailed description.

BRIEF DESCRIPTION OF THE DRAWINGS

FIG. 1 is an isometric view of the winch of the present invention;

FIG. 2 is an exploded view of certain drive components of the winch of FIG. 1;

FIG. 2A is a perspective view of a drive shoe of the winch of FIG. 1;

FIG. 3 is a sectional view taken along line 3—3 of FIG. 1;

FIGS. 9–12 are four semi-schematic views of the winch of the present invention in four different operating modes.

DESCRIPTION OF THE PREFERRED EMBODIMENT

Figure 4:
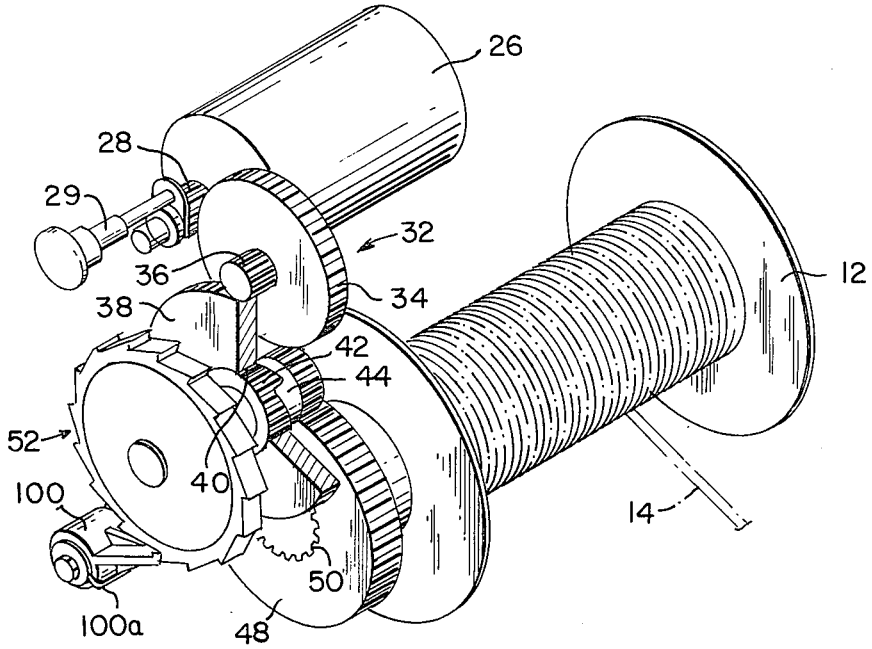
FIG. 4 is an isometric view of the winch of FIG. 1, with the housing structure removed for purposes of illustration.

In the accompanying drawing, there is shown a winch 10, comprising a drum 12 having a cable 14 wound thereon, and two end housings, namely a main drive housing 16 containing the drive components of the winch 10, and an opposite idler housing 18. The winch 10, as shown herein, is particularly adapted to be mounted to the front bumper 19 of an automotive vehicle, and thus the two housings 16 and 18 each have a forwardly facing contact surface 20 and 22, respectively, and sockets 24 by which the two housings 16 and 18 can be bolted to an automobile bumper.

In describing the winch 10, the term "forward" shall denote proximity to the contact surfaces 20 and 22 of the housings 16 and 18 and the term "rearward" shall denote a position from such contact surfaces on the opposite side of the axis of rotation of the drum 12. The term "right" denotes a direction from the main housing 16 toward the end housing 18, while the term "left" denotes a direction extending from the end housing 18 to the main housing 16.

As indicated previously herein, under the subject "Summary of the Invention," the present invention is an improvement in an existing prior art winch. It is believed that a clearer understanding of the present invention will be attained by first describing the main operating components which are common to the above-mentioned prior art winch and the winch 10 of the present invention, and then describing the mode of operation of the prior art winch. After this, the components and mode of operation of the present invention will be described in detail.

To describe now the main operating components which exist in the winch 10 of the present invention and in the prior art winch as well, there is an electric motor 26 which is mounted to the upper portion of the main drive housing 16 and drives a pinion gear 28. A manual first stage clutch 29 moves the pinion gear 28 axially into and out of engagement, to selectively supply power to a speed reducing gear transmission 30, which in turn powers the drum 10 to either reel in or pay out the cable 14. The power transmission 30 comprises a first cluster gear assembly 32 made up of a larger first stage gear 34 which engages the pinion gear 28, and a second pinion gear rigidly attached to the gear 34. The pinion gear 36 engages a larger second stage gear 38 mounted by a spline connection 40 to a first drive cam member 42.

There is a second drive cam member 44, axially aligned with the first cam member 42 and positioned just to the right thereof (as viewed from a position forwardly of the winch as shown in FIGS. 1 and 4). This second driven cam member 44 has a third pinion gear 46 formed integrally therewith, and this third pinion gear 46 meshes with a main drive gear 48 connected by a spline connection 50 to the drum 12.

Mounted to the left of the two cam members 42 and 44 and in axial alignment therewith is a clutch-brake assembly 52, made up of a center ratchet plate 54 and right and left disc shaped shoes 56 and 58, respectively, positioned on opposite sides of the ratchet plate 54. The manner in which the clutch-brake assembly 52 functions in cooperation with the two cam members 42 and 44 is particularly significant in the present invention and a clear understanding of the operation of these components is necessary for a proper appreciation of the present invention.

The right shoe 56 is a drive shoe and is mounted so as to rotate with the first drive cam 42. More particularly, with reference to FIGS. 2 and 3, the left hand portion 59 of the cam member 42 (that portion to the left of the spline 40) is cylindrical and fits with a radial bearing 60 and a seal member 62 within a cylindrical opening 64 in the main housing 16. Protruding axially from the left end of the cam member 42 is a drive lug 66 which extends into an arcuate matching slot 68 in the shoe 56 to cause the shoe 56 and the cam member 42 to rotate together.

The ratchet plate 54 has its outer circumference formed with a plurality of ratchet teeth 70, and radially inside of the ratchet teeth 70 there are a plurality of axial through holes 72 arranged in a circular pattern, with each hole 72 receiving a related friction button 74, with the buttons 74 providing frictional engagement with the shoes 56 and 58. The ratchet plate 54 is mounted by means of a plurality of ball bearings 76 on a cylindrical hub 78 which rides on an inner shaft member 80.

The left shoe 58 is the driven shoe and it is fixedly mounted to the left end of the inner shaft member 80 which is integral with the second driven cam member 44. This inner shaft member 80 extends through a series of aligned through openings formed in the drive cam member 42, the ratchet plate 54 and the two shoes 56 and 58. The left end of the shaft member 80 is formed with a circumferential groove 82 and a pair of axial slots 84 to receive, respectively, a retaining snap ring 86 and two key members 88, which members 86 and 88 fixedly secure the left driven shoe 58 to the shaft member 80 that is integral with the second driven cam member 44.

The right axially facing surface of the first drive cam member 42 has two slanting cam surfaces 90 which are at an angle of about 15° to 20° with a plane perpendicular to the axis of rotation of the cam member 42. Also, the first drive cam member 42 has a pair of circumferential shoulders 92, the surfaces of which are parallel to the axis of rotation of the cam member 42. The driven cam member 44 has a pair of matching cam surfaces 94 to engage the cam surfaces 90 in wedging engagement, and a pair of shoulders 96 to engage the shoulders 92 in positive engagement.

At this point in the description of the preferred embodiment, let us now review the main functional components thus far described. With regard to the operation of the winch 10, these can be grouped as follows:

a. The motor 26 which supplies power for the winch.
b. A first power transmitting means, made up of the first stage gear cluster 32 (comprising a first main gear 34 and pinion gear 36) and a second stage gear 38 having the spline connection 40, the primary function of this first power transmitting means being to transmit power from the motor 26 to the first drive cam 42. This is designated **30*a***.
c. The first drive cam 42.
d. The second drive cam 44.
e. A second power transmitting means, made up of the third pinion 46 and main drive gear 48, the function of these components being to transmit power from the second driven cam member to the drum 12. This is designated 30*b*.

f. The drum 12.

g. The clutch-brake assembly 52, whose essential function is to provide between the two cam members 42 and 44 a multipurpose operative connection, the nature of which will be described more fully hereinafter. This clutch-brake assembly is made up of three main subcomponents, namely:

1. The ratchet plate 54;
2. The power input shoe 56 that is mounted to rotate with the first drive cam 42, and
3. The power output shoe 58 which is fixedly mounted to the second driven cam member 44.

These main functional components listed immediately above in paragraphs (a) through (g) exist in the prior art winch described previously herein under the heading, "Description of the Prior Art" (although not in the precise physical configuration shown herein), and also in the winch of the present invention.

Attention is now directed briefly to two additional components not existing in the prior art winch, these two components being: (a) a compression spring 98 mounted between the two clutch-brake assembly shoes 56 and 58, and (b) a constantly engaged pawl 100 having a constantly engaged spring 100*a* which causes the pawl 100 to engage the ratchet plate 54 at all times. In the prior art winch described previously herein, there is a pawl having an operating lever which moves the pawl between an engaged and disengaged position with respect to the ratchet plate 54. At this point in this specification, there will be described the manner in which these components (a) through (g) function in the prior art winch, without the spring 98 and with a pawl that can be moved between an engaged and a disengaged position.

Reference is made to FIGS. 5 through 8 which show four operating modes of the prior art winch described above. To distinguish the components shown in FIGS. 5 through 8 as those components of the prior art winch described previously herein, these components will be given numerical designations which are the same as the corresponding components in the winch of the present invention, with a prime (′) distinguishing them as prior art components.

Figure 5:
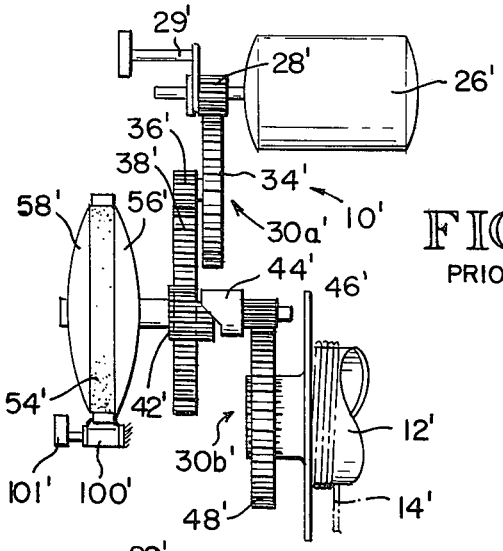
FIG. 5 PRIOR ART
FIGS. 5–8 are four schematic views of a prior art winch on which the present invention is based, in different operating modes.

In FIG. 5, the winch 10′ is shown operating under power to reel in the cable 14′, with the manual first stage clutch 29′ pushed in to engage the pinion 28′ with the gear 34′. Power from the motor 26′ is transmitted through the first power transmitting gears 34′–38′ to cause the first drive cam 42′ to rotate in a direction (upwardly as seen in FIG. 5) to be forced into wedging engagement with the second driven cam 44′. This causes the drive cam 42′ to be moved to the left, as seen in FIG. 5, so that the shoe 56′ engages the ratchet plate 54′ and in turn presses it against the shoe 58′. This essentially locks the clutch-brake assembly 52′ in place so that the two cams 42′ and 44′ and the clutch-brake assembly 52′ all rotate as a single power transmitting unit. Thus, the second driven cam 44′ acts through the second power transmission 30*b*′ to cause the drum 12′ to rotate in a direction to reel in the cable 14′. It will be noted that the pawl 100′ is in its engaged position. However, the ratchet plate 54′ is rotating in the "reeling in" direction, which rotation is permitted by the pawl 100′.

Figure 6:
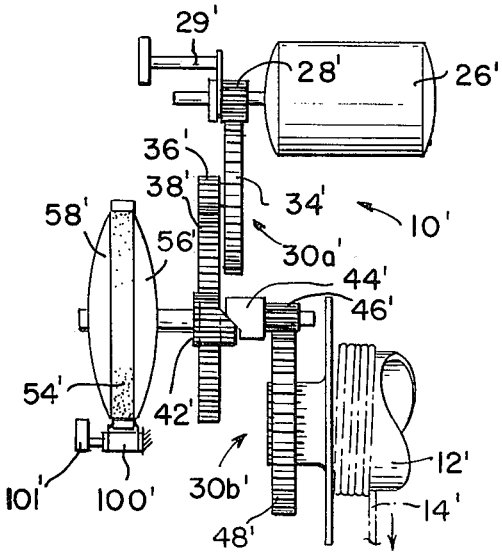
FIG. 6 PRIOR ART

In FIG. 6, the winch 10′ is shown in its operating condition to pay out cable under power, for example in the situation where the winch 10′ is lowering a load. In terms of physical position, all the components appear to be in the same location as shown in FIG. 5. However, the pawl 100′, still being engaged, prevents the ratchet plate 54′ from rotating in the opposite direction to pay out the cable 14′, so there must be relative rotation between the shoes 56′ and 58′ and the ratchet plate 54′. The motor 26′ transmits power to the first cam 42′ to tend to move the cam 42′ out of wedging engagement with the cam member 44′. However, since there is a tension load on the cable 14′, torque is transmitted through the drum 12′ through the gears that make up the second power transmitting means 30*b*′ to tend to cause the second cam member 44′ to overrun the first cam member 42′ and force it back into wedging engagement.

This presses the right shoe 56′ into frictional engagement with the now stationary ratchet plate 54′, to retard rotational movement of the shoe 56′ and the cam 42′ which rotates with the shoe 56′. However, as the drive cam 42′ continues to be rotated by the motor 26′, it tends to move the two cams 42′ and 44′ back out of wedging engagement. In actual operation this condition stabilizes so that the drum 12′ rotates only at the speed permitted by the rotational speed of the motor 26′, with the major torque loads exerted back through the winch components being absorbed in the frictional engagement of the shoes 56′ and 58′ with the ratchet plate 54′.

Figure 7:
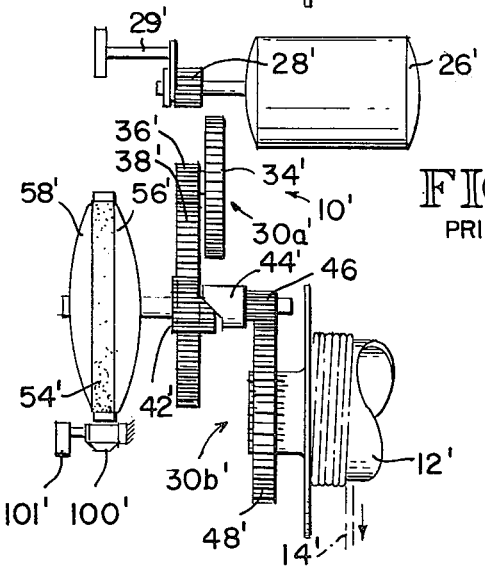
FIG. 7 PRIOR ART

In FIG. 7, there is shown a third operating condition of the winch 10′, where the first stage motor clutch 29′ is disengaged, and the ratchet 100′ has been manually moved by its lever 101 to its disengaged position. In this operating condition, the free end of the cable 14′ can be unwound at a relatively rapid rate from the drum 12′. The only retarding force on the rotation of the drum 12′ is the internal friction and inertia of the two gear power transmitting means 30*a*′ and 30*b*′, the two cams 42′ and 44′, and the clutch-brake assembly 52′. After the desired amount of cable 14′ has been reeled out, it is essential that the pawl 100′ be manually moved back to its engaged position so that the winch 10′ can function properly in its two power modes, as illustrated in FIGS. 5 and 6.

Figure 8:
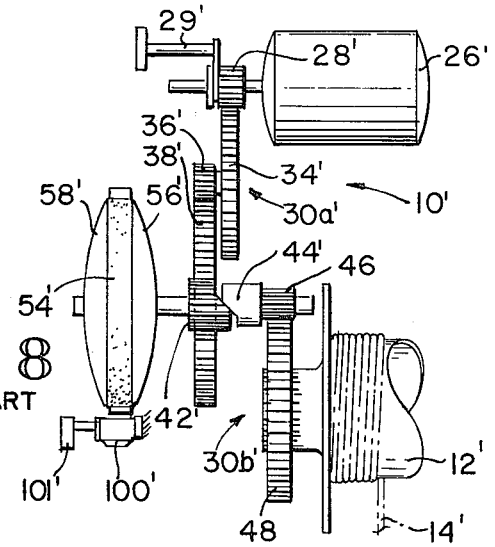
FIG. 8 PRIOR ART

In FIG. 8, the prior art winch 10′ is shown in a fourth situation which is an improper operating condition of the winch 10′. In this condition, the operator has engaged the first stage clutch 29′, but has neglected to move the manual lever 101 to cause the pawl 100′ to engage the ratchet plate 56′. If the motor 26′ is now operated to reel in the cable 14′, as in lifting a load above the ground surface, the winch 10′ can perform this lifting function. However, as soon as the motor 26′ is stopped, the load on the cable 14′ exerts a torque back through the operating components of the winch 10′ to tend to drive the motor 26′ in reverse. If the tension load on the cable 14′ is at all substantial (as in the case of lifting a rather heavy load), the internal drag of the operating components of the winch 10′ and of the motor 26′ is not sufficient to prevent the drum 12′ from unwinding cable under the tension loading on the cable 14′. The load simply descends at an increasing rate of speed and can actually burn out the winch motor 26′.

One possible means of remedying the situation shown in FIG. 8 is to provide an interlock of some sort between the first stage manual clutch 29′ and the pawl 100′, so that the winch 10′ cannot be operated under power unless the pawl 100′ is engaged. One disadvantage of this is that it adds complexities to the system which in turn introduce their own problems of reliability. Also, it is still possible for the extremely careless operator to utilize the winch 10′ improperly.

For example, let it be assumed that the operator disconnects the initial clutch 29′ and the pawl 100′ and pulls the free end of the cable 14′ to the edge of a steep ravine, with the intention of making a controlled descent down the ravine. He then calls instructions to a companion to start the winch motor 26′ to unwind cable and steps over the edge of the ravine. If his companion has not properly complied with his request to operate the motor with both the initial clutch 29′ and the pawl 100′ in engagement, the operator can step over the edge of the steep incline and instead of the cable lowering him at a controlled safe rate, the operator descends at a rate faster than that desired.

The present invention was created to improve the operating features of the winch 10′ described above with reference to FIGS. 5 through 8. The intent of the present invention is to utilize the basic functional advantages of the major components of the prior art winch 10′, without substantial manufacturing or design changes. This was accomplished by providing a constantly engaged pawl 100 without any disengaging means, and also providing a biasing means which operates within a predetermined force range to urge the shoes 56 and 58 toward a disengaged position. In the preferred form, the biasing means is the form of the compression spring 98 of a predetermined strength, positioned between the two clutch-brake shoes 56 and 58.

The significance of the introduction of these two components 98 and 100 into the main functional components of the prior art winch 10′ is based upon the recognition of certain force relationships in the prior art winch 10′. These are discussed previously herein under the heading, "Summary of the Invention," and will be discussed in more detail later herein, after the several modes of operation of the present invention are discussed immediately below with reference to FIGS. 9 through 12.

In FIG. 9, the winch 10 of the present invention is shown in its power operating condition reeling in the cable 14. In this condition, the winch 10 of the present invention operates in the same manner as the prior art winch 10′ operates, as illustrated in FIG. 5. The compression spring 98 is not of sufficient strength to push the two clutch-brake shoes 56 and 58 apart, and the constantly engaged pawl 100 permits the ratchet plate 54 to rotate in a manner to cause the cable 14 to be reeled in.

In FIG. 10, the winch 10 of the present invention is shown operating under power to pay out cable under tension loading as in lowering a load from an elevated position. The corresponding operating condition of the prior art winch 10′ is shown in FIG. 6, and the mode of operation of the present invention as shown in FIG. 10 is substantially the same as that shown in FIG. 6. Again, the force of the spring 98 is not sufficient to move the brake-clutch plates 56 and 58 out of frictional engagement with the stationary ratchet plate 54, and the cable 14 pays out at a controlled rate determined by the rotational speed of the motor 26.

Before proceeding to a discussion of FIGS. 11 and 12, which show further operating modes of the winch 10, let us first review the application of forces through the components of the winch 10 in the operating modes of FIGS. 9 and 10. Winches generally have a practical minimum and maximum operating range with regard to the tension loading which is placed on the winch's cable. The maximum loading is that beyond which the components of the winch can possibly experience failure, or beyond which the power source (i.e. motor) can no longer produce enough power to cause the winch to operate. The practical minimum loading is that under which it becomes pointless to use a winch. (In other words, a winch would normally not be used to raise a load which an average worker could simply raise manually.)

Within the normal operating range of the winch 10, the tension loading on the cable 14 causes torque to be transmitted through the winch components to cause an axially directed force to be exerted between the cam faces 90 and 94 of the two cam members 42 and 44 to tend to move the two cam members 42 and 44 axially away from each other so as to move the shoes 56 and 58 into engagement with the ratchet plate 54. Previously in this specification, under the heading, "Summary of the Invention," this is designated "Force B." This Force B is of sufficient magnitude to overcome the force of the spring 98 so as to move the shoes 56 and 58 into engagement with the ratchet plate 54. Thus, in the situations described with reference to FIGS. 9 and 10, the mode of operation is the same as with the prior art winch 10′.

In FIG. 11, the winch 10 of the present invention is shown in a third operating mode where the first stage clutch 29 is disengaged and a moderate tension load is being exerted on the cable 14 to unwind the cable 14 from the drum 12. This would occur in a situation where a person grasps the cable 14 and walks at a moderate rate away from the winch 10. It will be noted that the constantly engaged pawl 100 is, as its name implies, still is in engagement with the ratchet plate 54. However, the spring 98 has moved the two clutch-brake shoes 56 and 58 apart from each other and out of engagement with the ratchet plate 54 so that the two shoes 56 and 58 can rotate freely of the ratchet plate 54. In this situation the forces resisting the paying out of the cable 14 from the drum 12 are the total frictional forces of the rotating components of the winch 10, plus any inerial forces which occur when the cable 14 is being payed out at an accelerating rate of speed.

However, with regard to the force relationships which are functionally critical in the present invention, the significant force component in this operating mode (i.e. that shown in FIG. 11) is that imparted by the operating components of the first power transmitting means 30*a*, cam member 42 and the drive shoe 56. These components collectively exert a back torque on the cam 42 which results in an axial force tending to move the two cam members 42 and 44 apart. Previously in this specification under the heading, "Summary of the Invention," this force is designated "Force A," and acts in a direction to move the two cam members 42 and 44 apart so as to cause the shoes 56 and 58 to come into engagement.

However, as can be seen from an examination of FIG. 11, this Force A is not sufficient to overcome the counterforce of the spring 98, and the clutch brake shoes 56 and 58 remain out of engagement. In this condition, the free end of the cable 14 can be grasped manually and pulled out at a moderate rate of speed without causing the brake shoes 56 and 58 to lock up. However, prior to beginning the unwinding of the cable 14, the motor 26 should be engaged and operated for just a brief moment in reverse to insure that the cam member 42 has moved out of tight wedging engagement with the cam member 44.

In FIG. 12, there is shown a fourth operating condition of the winch 10 of the present invention. It will be noted that the pawl 100 is still engaged. (As stated earlier herein, the pawl 100 remains engaged at all times, unless it is deliberately tampered with.) However, it will be observed, that the two shoes 56 and 58 have moved against the force of the spring 98 and are in frictional engagement with the ratchet plate 54.

This situation which is shown in FIG. 12 results from pulling the cable 14 out at a rate of acceleration beyond the desired maximum rate. This situation would occur, for example, where the operator is pulling out the cable 14 over very difficult terrain, and the operator stumbles over a steep incline so that the operator, still holding the cable, begins to accelerate down the incline. In this circumstance, let us analyze the various force components which are acting through the winch components.

Again, the total internal frictional forces and inertial forces of all the rotating components of the winch 10 will act to retard the rate of acceleration of the rotation of the drum 12. However, as with the condition of FIG. 11, the critical forces with regard to the operation of the clutch-brake assembly 52 are those exerted on the power input side of the first cam 42. In this situation, the inertial forces of the cluster gear assembly 32, the second main gear 38, and the drive cam 42 and the drive shoe 56 are sufficient, when added to the internal frictional drag forces of these components to exert an axial force between the cam members 42 and 44 greater than the biasing force of the spring 98. This causes the shoes 56 and 58 to move into engagement with the ratchet plate 54 which is held stationary by virtue of the constantly engaged pawl 100. This engagement causes the cams 42 and 44 to wedge tightly against one another to stop any further rotation of the drum 12. To permit the cable 14 to be payed out further, the motor 26 must be engaged and operated in a direction to pay out cable to rotate the drive cam 42 out of wedging engagement. After this, more cable 14 can be payed out in the manner shown in FIG. 11.

The force which is exerted axially between the two cam members 42 and 44 in the operating mode of FIG. 12 is designated previously in the section "Summary of the Invention" as "Force C." The biasing force of the spring 98 has previously been designated "Force D." For the winch 10 of the present invention to function properly, the biasing force of the spring 98 (Force D) must be greater than Force A and less than either Force B or Force C. Desirably, the biasing force of the spring 98 (i.e. Force D) should be sufficiently higher than Force A to permit a moderate accelerating force to be imparted to the power input components to the cam 42 so that the resulting addition of such moderate inertial forces with the internal drag forces acting on the power input side of the cam member 42 are not sufficient to overcome the biasing force of the spring.

What is claimed is:

1. In a winch comprising:

a. a drum adapted to have a cable wound thereon, b. a first power transmitting means operatively connected to said drum, c. a driven cam member having an axially facing cam surface and having an operative connection to said first power transmitting means, said cam being rotatable in a first direction to cause said drum to turn so as to reel in cable, and rotatable in a second direction to cause said drum to pay out cable, d. a rotatably mounted second driving cam member having an axially facing second cam surface to engage said first cam surface, said second cam member being rotatable in a first direction to engage said first cam member in wedging engagement to urge said first and second cam members axially away from each other and to tend to drive said cam member in its first direction to reel in cable, and rotatable in a second direction to move away from wedging engagement to permit said first cam member to rotate in its second direction to pay out cable, e. second power transmitting means to transmit power from a power source to said second drive cam, f. a brake-clutch assembly comprising:

1. a rotatably mounted ratchet plate,
2. a first shoe mounted on one side of the ratchet plate and connected to the first driven cam so as to rotate therewith,
3. a second shoe mounted on the other side of the ratchet plate and connected to the second cam member so as to rotate therewith, g. said first and second shoes being connected to said first and second cam members to be movable toward each other and into frictional engagement with said ratchet plate by movement of the first and second cam members axially away from each other, and movable away from each other and out of frictional engagement with the ratchet plate by movement of the first and second cam members axially toward each other, whereby wedging engagement of the two cam members tends to move the shoes into engagement, and movement of the cam members out of wedging engagement permits the shoes to move up out of engagement, h. said winch being characterized in that:

1. when the winch is rotating in a direction to pay out cable at a constant speed by virtue of an exterior force acting on said drum, there are internal drag forces on the second drive cam including the drag of the second power transmitting means, the second shoe and the second cam member, which drag results in a first axially directed force component being created between the two cam members to urge said cam members away from each other and urge the shoes into engagement,
2. said winch has a practical minimum and maximum operating range with regard to the magnitude of torque loads against which the drum acts, and with the winch reeling in or paying out cable at the practical minimum operating limit, the torque load on the drum, acting back through the driven cam, produces a second axially directed force component tending to move the cams away from each other to cause the shoes to engage,
3. with the shoes disengaged, and with a tension load being applied to the cable so that cable is paying out at an accelerating rate of speed, there is practical upper limit to the level of acceleration of rotational speed of the winch drum, and at such level of acceleration, the frictional drag forces that act on the second drive cam and inertial forces of those components which act on the second drive cam, including the second shoe, the second power transmitting means and the second drive cam itself, are additive, this resulting in a third axially directed force component tending to move the two cams away from each other and cause the shoes to be engaged, 4. said winch being so constructed that the first force component is less than the second force component or the third force component, the improvement comprising:

a. constantly engaged pawl means which engage said ratchet plate in a manner that under all operating conditions of the winch, said ratchet plate is permitted to rotate only in a direction to reel in cable, and b. biasing means to exert a fourth axially directed force component to urge said shoes out of engagement and urge said cam members axially toward each other, said biasing means being such that said fourth force component is greater than said first force component but less than said second or third force component, whereby:

1. with the winch operating under power to reel in cable, as in lifting a load, the shoes are engaged with the ratchet plate, so that when power is turned off, the clutch-brake assembly functions as a brake to stop cable from paying out under the force of the external load, 2. with the winch operating under power to pay out cable as in lowering a load, the shoes are in engagement with the ratchet plate, so that sliding engagement occurs with the clutch-brake assembly acting as a speed governor to prevent the drum from overrunning the power source, 3. with cable being pulled off the drum at a moderate rate of acceleration, the shoes remain disengaged to permit the paying out of cable with the ratchet plate remaining stationary, and 4. in a situation where cable is paying out at an excessive rate of acceleration, the shoes engage the stationary ratchet plate to act as a brake and stop further paying out of cable.

2. The improvement as recited in claim 1, wherein said biasing means directly engages said first and second clutch shoes.

3. The improvement as recited in claim 2, wherein said biasing means is spring means urging said shoes away from each other.

4. The improvement as recited in claim 1, wherein said biasing means is spring means urging said shoes away from each other.

5. The improvement as recited in claim 1, wherein said biasing means is a compression spring positioned between said shoes so as to urge said shoes apart with a force equal to the value of said fourth force component.

6. The improvement as recited in claim 1, wherein said constantly engaged pawl means comprises a pawl member having a constantly engaged spring urging the pawl member against the ratchet plate.

7. The improvement as recited in claim 1, wherein:

a. said biasing means is a compressiong spring positioned between said shoes so as to urge said shoes apart with a force equal to the value of said fourth force component, b. said constantly engaged pawl means comprises a pawl member having a constantly engaged spring urging the pawl member against the ratchet plate.

* * * * *